United States Patent [19]

Price et al.

[11] 4,003,721

[45] Jan. 18, 1977

[54] CYLINDRICAL GRINDER

[75] Inventors: Ralph E. Price; James C. Harris, both of Waynesboro, Pa.

[73] Assignee: Landis Tool Company, Waynesboro, Pa.

[22] Filed: Apr. 26, 1976

[21] Appl. No.: 680,040

[52] U.S. Cl. ..... 51/105 SP; 51/237 CS

[51] Int. Cl.[2] ..... B24B 5/42

[58] Field of Search ..... 51/73 GC, 105 R, 105 SP, 51/237 CS, 217 T, 237 R

[56] References Cited

UNITED STATES PATENTS

| | | | |
|---|---|---|---|
| 2,737,761 | 3/1956 | Berry | 51/237 CS |
| 3,142,941 | 8/1964 | Fournier | 51/237 CS X |
| 3,646,710 | 3/1972 | Flohr | 51/237 CS X |

FOREIGN PATENTS OR APPLICATIONS

| | | | |
|---|---|---|---|
| 253,928 | 12/1926 | United Kingdom | 51/73 GC |

*Primary Examiner*—Al Lawrence Smith
*Assistant Examiner*—Nicholas P. Godici
*Attorney, Agent, or Firm*—Spencer T. Smith

[57] ABSTRACT

A cylindrical grinder comprising means including a drive plate and a clamping assembly secured to the drive plate for rotating a workpiece about a selected axis, the workpiece having an end main bearing, a first work diameter to be machined, a second main bearing intermediate the end bearing and the first work diameter and adjacent the first work diameter, a second work diameter, which is not to be ground while the first work diameter is being ground, located intermediate the second main bearing and the end bearing and adjacent the second main bearing, a grinding wheel assembly including a grinding wheel for effecting stock removal from the first work diameter, the clamping assembly including means for clamping the end main bearing and the second main bearing of the workpiece to prevent the axial or rotational displacement of the workpiece relative to the clamping assembly.

7 Claims, 3 Drawing Figures

CYLINDRICAL GRINDER

Where a small crankshaft, having one crankpin is to be machined, the crankshaft may be driven by a single work head which clamps the end portion of the crankshaft to permit the crankpin adjacent the work head to be ground to size when properly supported by a workrest. Such a clamp, which has a single shoe with spaced pads, clamps the end main bearing and the end portion of the crankshaft within associated throw blocks.

In a conventional cylindrical grinder which for example machines a crankshaft having a plurality of crankpins each located between mainbearings the end main bearings of a workpiece are clamped in and rotatively driven by opposing work heads. To prevent or minimize the bowing of the workpiece, a work rest is utilized to engage the rotating workpiece during stock removal. This workrest is subject to wear and requires periodic maintenance.

It is accordingly an object of the present invention to provide a workpiece clamping arrangement for a cylindrical grinder wherein the normally required workrest can be eliminated.

One of the advantages of the present invention is that a workpiece can be supported and driven by a single work head whereby the normally required second work head, which must be aligned and coordinated with the first work head, can be eliminated.

Other objects and advantages of the present invention will become apparent from the following portion of this specification and the accompanying drawings which illustrate in accordance with the mandate of the patent statutes presently preferred embodiments incorporating the principles of the invention.

Referring to the drawings.

Figure 1:
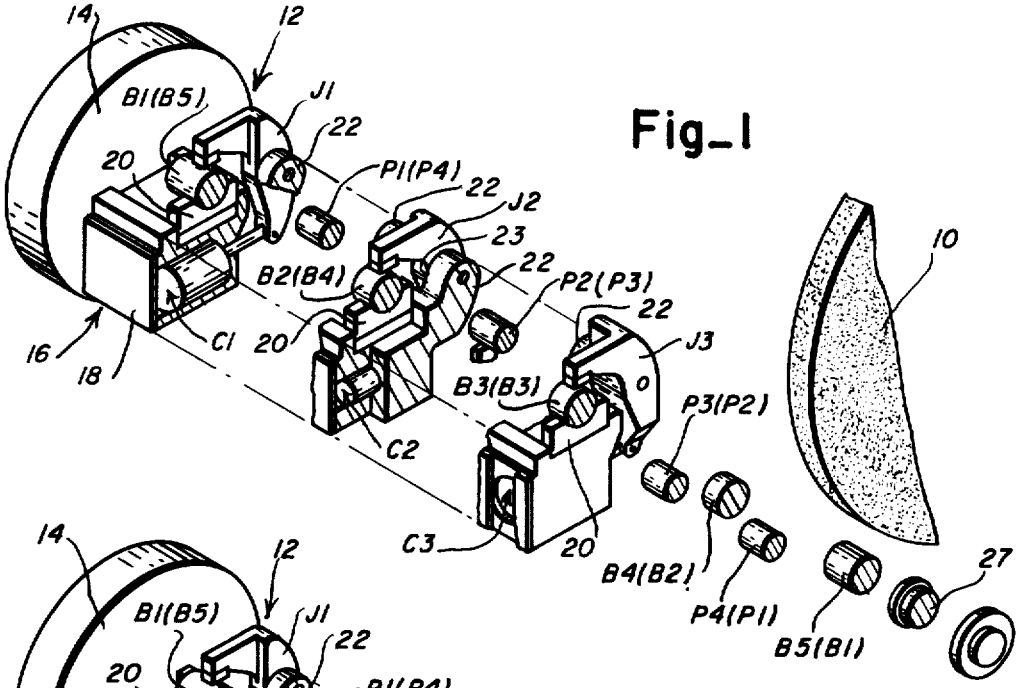
FIG. 1 is a partial perspective view of a cylindrical grinder, having a first preferred embodiment, made in accordance with the teachings of the present invention.
Figure 2:
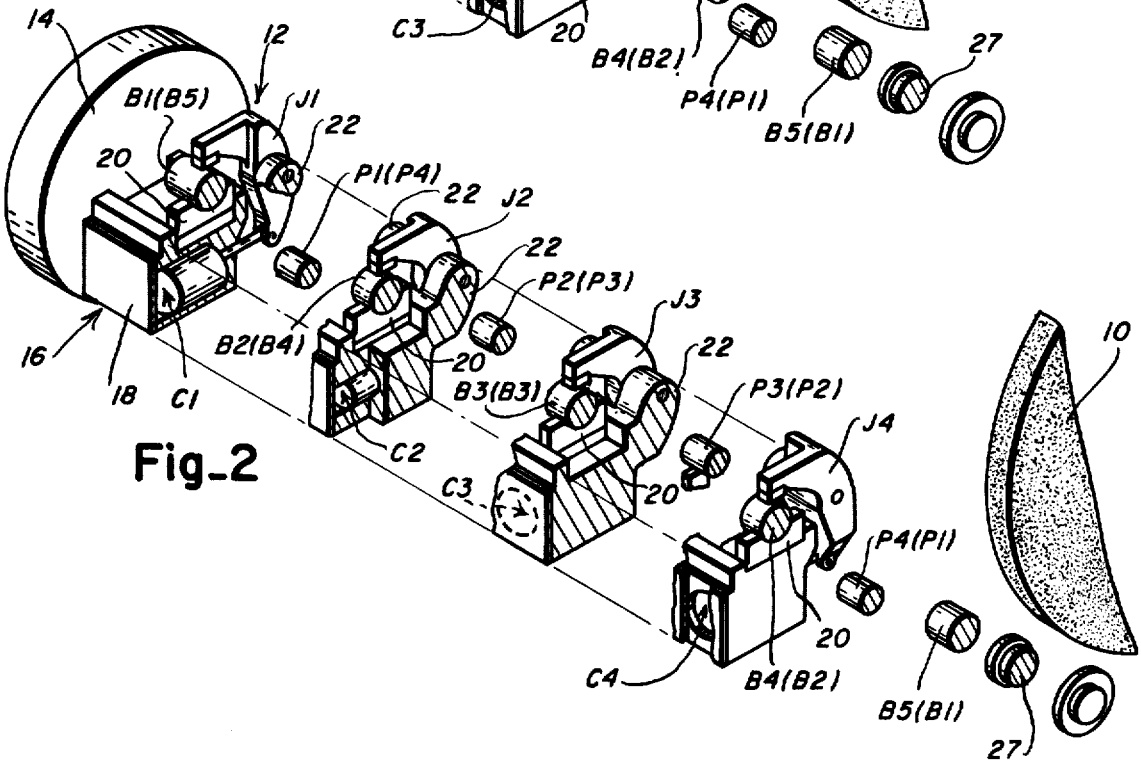
FIG. 2 is a view, similar to that of FIG. 1, of a cylindrical grinder, having a second preferred embodiment, made in accordance with the teachings of the present invention.
Figure 3:
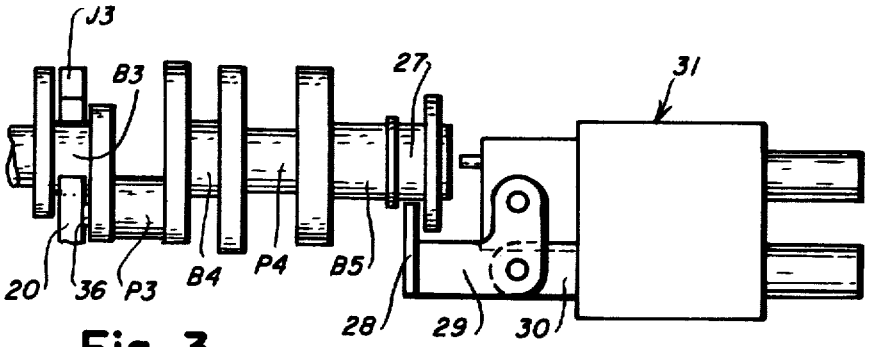
FIG. 3 is an elevational view of a cradle support mechanism which may be utilized to prevent the tipping of a workpiece manually loaded into a cylindrical grinder such as illustrated in FIG. 1.

The cylindrical grinder illustrated in FIG. 1 is a crankpin grinder which includes a grinding wheel assembly having a single rotatable grinding wheel 10. The grinding wheel may be selectively advanced into abrasive engagement with a selected crankshaft crankpin P3, which is being rotatively driven about its axis by a work head.

The crankshaft, which in the preferred embodiments is a crankshaft for a V-8 engine, includes five coaxial main bearings B1, B2, B3, B4, B5, which are substantially equally spaced, and four 90° angularly spaced crankpins P1, P2, P3, P4. The crankpins are also substantially equally spaced axially and are located centrally intermediate adjacent bearings.

Accordingly, while the crankpins and main bearings of the crankshaft are identified in ascending order from left to right in the drawings, they could also be identified in descending order (the nomenclature presented in parentheses) such as would be proper if the right and left hand ends of the crankshaft were reversed.

The sole work head 12 includes a drive plate 14 and a clamping assembly 16, which is integrally secured to the drive plate. The clamping assembly 16 includes a base 18, which supports three throw blocks 20 operatively associated with the three main bearings B1, B2, B3, intermediate the pin to be ground P3 and the drive plate 14. The base 18 includes an upstanding portion 22, which pivotally supports clamps or jaw members J1, J2, J3, operatively associated with each throw block. The first and third jaw members J1, J3, are pivotally mounted on the opposing ends of this upstanding portion and the central jaw member J2 is pivotally mounted within a slot 23 defined in this upstanding portion. Each jaw member is individually controlled by an associated hydraulic cylinder C1, C2, C3, which is selectively connected to a source of pressurized fluid (not shown).

To position a crankshaft in the clamping assembly, all three jaws are fully opened. Main bearings B1, B2, and B3 are located within their associated throw blocks. The central hydraulic cylinder C2 is then actuated at low pressure to advance the central jaw J2 so that the crankshaft will be secured. The hydraulic pressure of the central hydraulic cylinder C2 at this time is selected to be low enough so that the crankshaft can be axially and radially displaced while the central clamp is closed.

When the crankshaft has been axially and radially located (the orientation of the workpiece is such that the axis of rotation of the work head coincides with the axis of the pin to be ground P3), the end clamps J1, J3, are forcefully closed by identical hydraulic cylinders C1, C3, which operate at high pressure. The pressure of the end hydraulic cylinders is selectively chosen to be high enough to prevent any axial or rotational displacement of the crankshaft, relative to the throw blocks during the grinding operation. The crankshaft will accordingly be completely unsupported beyond the third main bearing B3 when the third pin P3 is ground to size. While in this preferred embodiment only the end jaws are subjected to high pressure, it is to be understood that the central jaw could be selectively operable under low pressure during axial and rotational location of the crankshaft and operable under high pressure when the end jaws are subjected to high pressure.

Additionally, while only a single pin P3 is ground in this preferred embodiment, the third P3 and fourth P4 pins might be simultaneously ground by a grinding wheel assembly having a pair of grinding wheels where these two pins are coaxial. In such a case both pins P3, P4, would constitute the portion being ground to size.

In the second preferred embodiment where the fourth crankpin P4 is to be ground, the clamping assembly includes four throw blocks 20 and four clamps of jaws J1, J2, J3, J4. The first, third, and fourth hydraulic cylinders C1, C3, C4, are identical to the first and third C1, C3, hydraulic cylinders of the first preferred embodiment. The second hydraulic cylinder C2, the end jaws and the central jaw or jaws of each embodiment are the same. This crankshaft will be completely unsupported beyond the fourth main bearing B4 when the fourth crankpin P4 is ground to size.

Depending on the characteristics of the workpiece being ground to size in the second preferred embodiment, the end jaws J1, J4, only, may be subjected to high pressure or three jaws J1, J3, J4 (or J1, J2, J4, with the second and third cylinders C2, C3, being switched), may be subjected to high pressure. All four jaws could be subjected to high pressure at the same time if desired.

If the cylindrical grinder illustrated in FIG. 1 is to be manually loaded, the workpiece might tip out of the throw blocks prior to the advancement of the locating jaw. To preclude this, a cradle member 28 is positioned to be proximate the bottom of the oil seal of the workpiece when it is placed in the throw blocks. The cradle member is secured to one end of a control member 2B which is pivotally secured at the other end to a housing and which is pivotally secured at its center to a hydraulic cylinder 30. When the workpiece has been clamped this hydraulic cylinder 30 can be retracted to lower the cradle member.

What is claimed is:

1. A cylindrical grinder comprising means including drive plate and a clamping assembly secured to said drive plate, means for rotating a workpiece about a selected axis, the workpiece having an end main bearing, a first work diameter to be ground, a second main bearing intermediate the end bearing and the first work diameter and adjacent the first work diameter, a second work diameter, which is not to be ground while the first work diameter is being ground, located intermediate the second main bearing and the end bearing and adjacent the second main bearing, a grinding wheel assembly including a grinding wheel for effecting stock removal from the first work diameter, said clamping assembly including means for clamping the end main bearing and the second main bearing of the workpiece to prevent the axial or rotational displacement of the workpiece relative to said clamping assembly.

2. A cylindrical grinder according to claim 1, wherein said clamping means comprises a base integrally secured to said drive plate including throw blocks associated with said end main bearing and said second main bearing, a jaw associated with each of said throw blocks, said base including means for movably supporting said jaws, and means for advancing said jaws to clamp the end main bearing and said second main bearing within said throw blocks.

3. A cylindrical grinder according to claim 2, the workpiece having a third main bearing intermediate the second work diameter and the end bearing and adjacent the second work diameter, said clamping assembly further comprising a throw block associated with the third main bearing, a jaw associated with said third throw block, said base further including means for movably supporting said third jaw, and means for advancing said third jaw to clamp the third main bearing within said third throw block.

4. A cylindrical grinder according to claim 1, the workpiece having a third main bearing intermediate the second work diameter and the end bearing and adjacent the second work diameter said clamping assembly further comprising a throw block associated with the third main bearing, a jaw associated with said third throw block, said base further including means for movably supporting said third jaw, and means for advancing said third throw block to locate the third main bearing within said third throw block.

5. A cylindrical grinder according to claim 1, further comprising cradle means, and means for displacing said cradle means from a retracted position remote from the end of the workpiece opposite the end main bearing to an advanced position proximate the opposite end.

6. A cylindrical grinder according to claim 3 wherein the workpiece has a third work diameter which is not to be machined at the same time as the first work diameter, intermediate the third bearing and the end main bearing and adjacent the third main bearing and a fourth main bearing intermediate the third work diameter and the end main bearing and adjacent the third work diameter, said clamping assembly further comprising a throw block and jaw associated with the fourth main bearing said base including means for movable supporting said fourth jaw, and means for advancing said fourth jaw to locate the fourth main bearing within said fourth throw block.

7. A cylindrical grinder comprising means including a drive plate and a clamping assembly secured to the drive plate for rotating a workpiece about a selected axis, the workpiece having a plurality of work diameters, one of which is to be ground and a plurality of main bearings located between one end of the workpiece and the one work diameter to be ground, at least one of the plurality of main bearings being located between the two work diameters, a grinding wheel assembly including a grinding wheel for effecting stock removal from the one work diameter, and a clamping assembly including means for clamping each of said plurality of main bearings.

* * * * *

UNITED STATES PATENT OFFICE

CERTIFICATE OF CORRECTION

Patent No. 4,003,721 Dated January 18, 1977

Inventor(s) Ralph E. Price et al.

It is certified that error appears in the above-identified patent and that said Letters Patent are hereby corrected as shown below:

In The Abstract:

Line 6, change "machined" to --ground--.
Line 12, after "bearing", insert --and--.

Column 1, line 5, delete "adjacent the work head".
Column 1, line 8, delete "portion".
Column 1, line 21, after "grinder" insert --for grinding a work diameter such as one crankpin of a multi-crankpin crankshaft--.
Column 1, line 24, after "workpiece" insert --such as a multi-crankpin crankshaft--.
Column 2, line 54, change "of" to --or--.

Column 3, claim 1, line 2, after "including" insert --a--.
Column 3, claim 1, line 3, after "plate" delete --, means--.
Column 3, claim 1, line 7, after "end" insert --main--.
Column 3, claim 1, line 11, after "end" insert --main--.
Column 4, claim 4, line 1, change "1" to --2--.
Column 4, claim 4, line 10, change "throw block" to --jaw--.

Signed and Sealed this second Day of August 1977

[SEAL]

Attest:

RUTH C. MASON
Attesting Officer

C. MARSHALL DANN
Commissioner of Patents and Trademarks